US007104002B2

(12) United States Patent
Rotundo

(10) Patent No.: US 7,104,002 B2
(45) Date of Patent: Sep. 12, 2006

(54) FULLY ADJUSTABLE STOCK FOR RIFLE

(76) Inventor: Fioravante Rotundo, Via Sapri No. 32, Lamezia Terme (IT) I-88046

( * ) Notice: Subject to any disclaimer, the term of this patent is extended or adjusted under 35 U.S.C. 154(b) by 0 days.

(21) Appl. No.: 10/519,499

(22) PCT Filed: Jul. 28, 2003

(86) PCT No.: PCT/EP03/08302

§ 371 (c)(1),
(2), (4) Date: Dec. 30, 2004

(87) PCT Pub. No.: WO2004/013560

PCT Pub. Date: Feb. 12, 2004

(65) Prior Publication Data

US 2005/0241205 A1 Nov. 3, 2005

(30) Foreign Application Priority Data

Jul. 30, 2002 (CZ) ..... CZ20020006 U

(51) Int. Cl.
*F41C 23/06* (2006.01)

(52) U.S. Cl. ..... 42/73; 42/71.01

(58) Field of Classification Search ..... 42/73, 42/72, 71.01, 74, 75.03
See application file for complete search history.

(56) References Cited

U.S. PATENT DOCUMENTS 1,063,061 A * 5/1913 Pickering ..... 42/73
4,203,244 A * 5/1980 Hickman ..... 42/73
4,532,730 A 8/1985 Hyytinen
5,031,348 A * 7/1991 Carey ..... 42/74
5,392,553 A * 2/1995 Carey ..... 42/73
5,933,997 A * 8/1999 Barrett ..... 42/73
5,970,642 A 10/1999 Martin
5,979,098 A * 11/1999 Griggs ..... 42/73

FOREIGN PATENT DOCUMENTS

| | | |
|---|---|---|
| CH | 96 004 | 9/1922 |
| DE | 101 14 199 | 11/2001 |
| FR | 1 170 937 | 1/1959 |
| FR | 2 791 767 | 1/2000 |

* cited by examiner

*Primary Examiner*—J. Woodrow Eldred
(74) *Attorney, Agent, or Firm*—Young & Thompson

(57) ABSTRACT

Adjustable stock for rifle, characterized in that it is divided into two elements by cutting: element (1) remains integral with the barrels and is connected to element (2), which rests on the shoulder of the shooter, by means of pins (8) whose position can be adjusted by screws (10, 11, 12) which allow relative movement of the two elements both laterally and vertically, one in relation to the other, for accurate regulation of the aim on the target.

7 Claims, 4 Drawing Sheets

FULLY ADJUSTABLE STOCK FOR RIFLE

BACKGROUND OF THE INVENTION

The present invention relates to a stock for rifle which can be fully adjusted both vertically and laterally and, by means of appropriate thicknesses of the butt plates, also in length.

Stocks for rifles are known on the market, above all in relation to the world of precision or sport shooting, which are known as "adjustable" due to the possibility of partially adjusting the shape of the stock, improving the support provided for the shooter during shooting.

This is because shooters have different physiques which affect the shooting position, in particular the various physical characteristics of the arm, of the position of the eyes and of the cheekbones affect the aim. In the man-rifle interaction, aim refers to the alignment between the eye, the shoulder and the line of aim of the rifle: clearly, when producing a rifle stock, account has to be taken of a set of parameters such as distance and height of eyes, position of the cheekbones and the extent of their projection, the length of the neck, the position of the shoulder whereon the rifle is rested, and the length of the arms and height of the person.

These elements are fundamental in the choice of the stock in order to achieve high precision of shooting, in particular in the case of shooting at a moving target for sport, or of marksmen.

The so-called "adjustable" stocks known on the market in actual fact only allow partial adjustments as only part of the stock can be regulated, unlike what is to be illustrated of the present invention herein below.

The most representative patent of the known state of the art is FR 2791767 wherein the part formed by the back, i.e. the upper part of the stock, and by part of the lateral surface of the stock, can be moved both laterally and vertically by means of micrometric screws, only altering the support provided by the stock for the shooter, yet maintaining the alignment between the end of the stock and the barrels of the rifle steady.

Another patent belonging to the known state of the art is U.S. Pat. No. 5,235,764: only the back can be moved both vertically and laterally, but in this case too the alignment between the barrels of the rifle and the stock end is maintained.

Systems are also known for adjustment of the butt plate, by moving it vertically or moving it away from the stock by means of spacers or pins.

In none of the patents which belong to the state of the art is the axis between the point of resting of the stock on the shoulder and the barrels of the rifle modified: the so-called "adjustment" therefore consists of a relative increase in the comfort for the shooter yet while maintaining alignment of the rifle: in practice adaptability of the shooter to the rifle is favoured, and not the reverse.

SUMMARY OF THE INVENTION

The object therefore of the present invention is that of producing a stock which can be fully adjusted and adapted to the shooter, in such a way that perfect alignment of the aim on the target to be hit can be achieved, with a lower likelihood of error on the same target.

A further object of the present invention is that of simplifying the production of the stocks: today's production method is in fact that of producing the stocks in different sizes with an increase in costs and a further complication, as for each model of rifle numerous sizes of stocks have to be produced to satisfy customers who obviously have heterogeneous physiques.

Last but not least, the production of the stock according to the present invention enables a saving in materials, above all wood, and a considerable decrease in costs, improving the efficiency of production.

The advantages lie therefore in the fact that with a single rifle the needs of people with different physiques can be satisfied, enabling them to adjust their own firearm in the manner most congenial to them without having to level off projections or, worse, change their natural shooting position to adapt better to the rifle.

Thus a rifle is obtained which adapts to the person and not the reverse.

A further advantage achieved, as will be illustrated herein below, is absorption of the recoil by the stock forming the object of the present invention, as it is no longer a rigid single part but is instead formed by two joined elements: the system which joins the two elements introduces a restraint which increases the elasticity of the body and therefore encourages absorption of the recoil which is not transferred directly to the shoulder but is damped by the connection system.

BRIEF DESCRIPTION OF THE DRAWINGS

These and other advantages will be made clearer by the description and by the accompanying drawings of a preferred embodiment.

DESCRIPTION OF THE PREFERRED EMBODIMENTS

Figure 1:
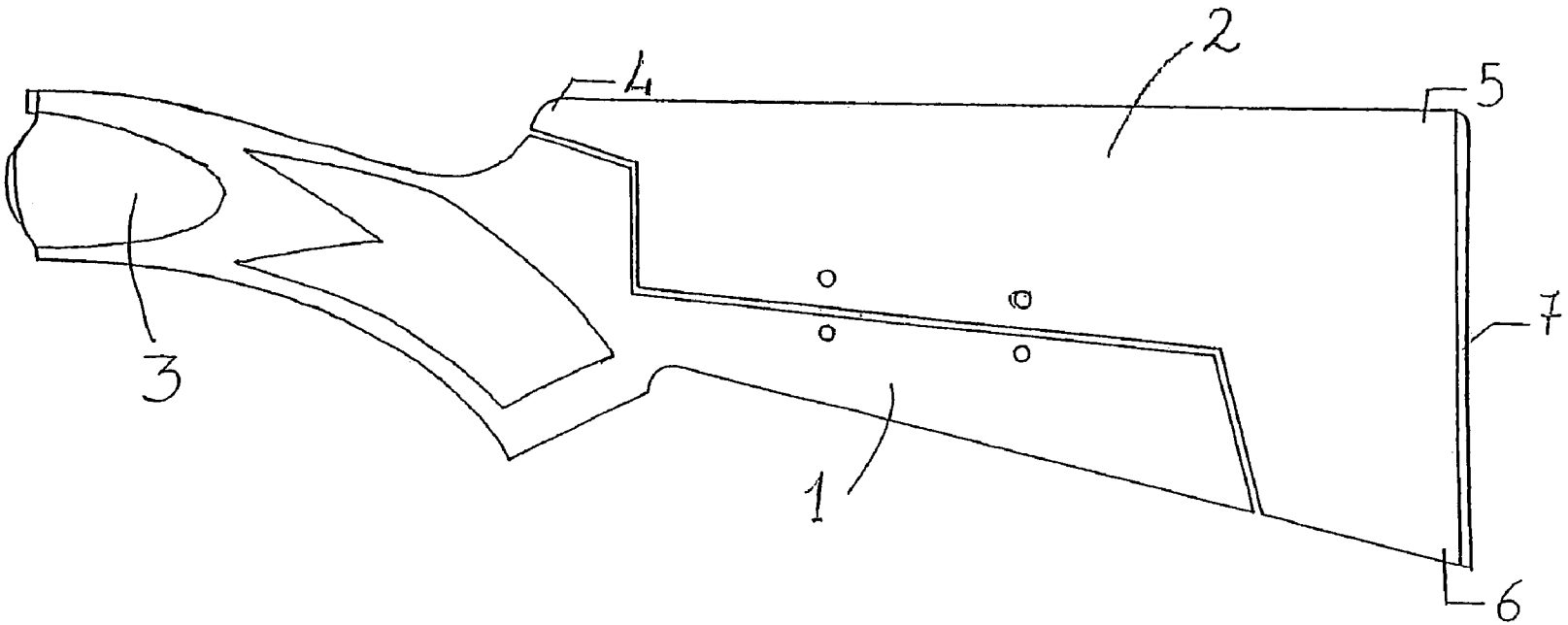
FIG. 1 illustrates the complete stock as it is presented.

Referring to FIG. 1, the stock is formed by the union of two elements wherein element 1 is integral with the breechblock 3 of the rifle and therefore with the barrels, while element 2 rests on the shoulder of the shooter. On element 2 the nose 4, the heel 5, the tip 6 and, in contact with the shoulder, the butt plate 7, can be seen.

As is clear, the stock consequently appears divided also from a structural point of view: from a rigid body formed by a single piece of wood as it was originally, it becomes a body formed by two separate elements joined to each other and with different tasks and functions: the union of these two elements forms the actual stock.

Figure 2:
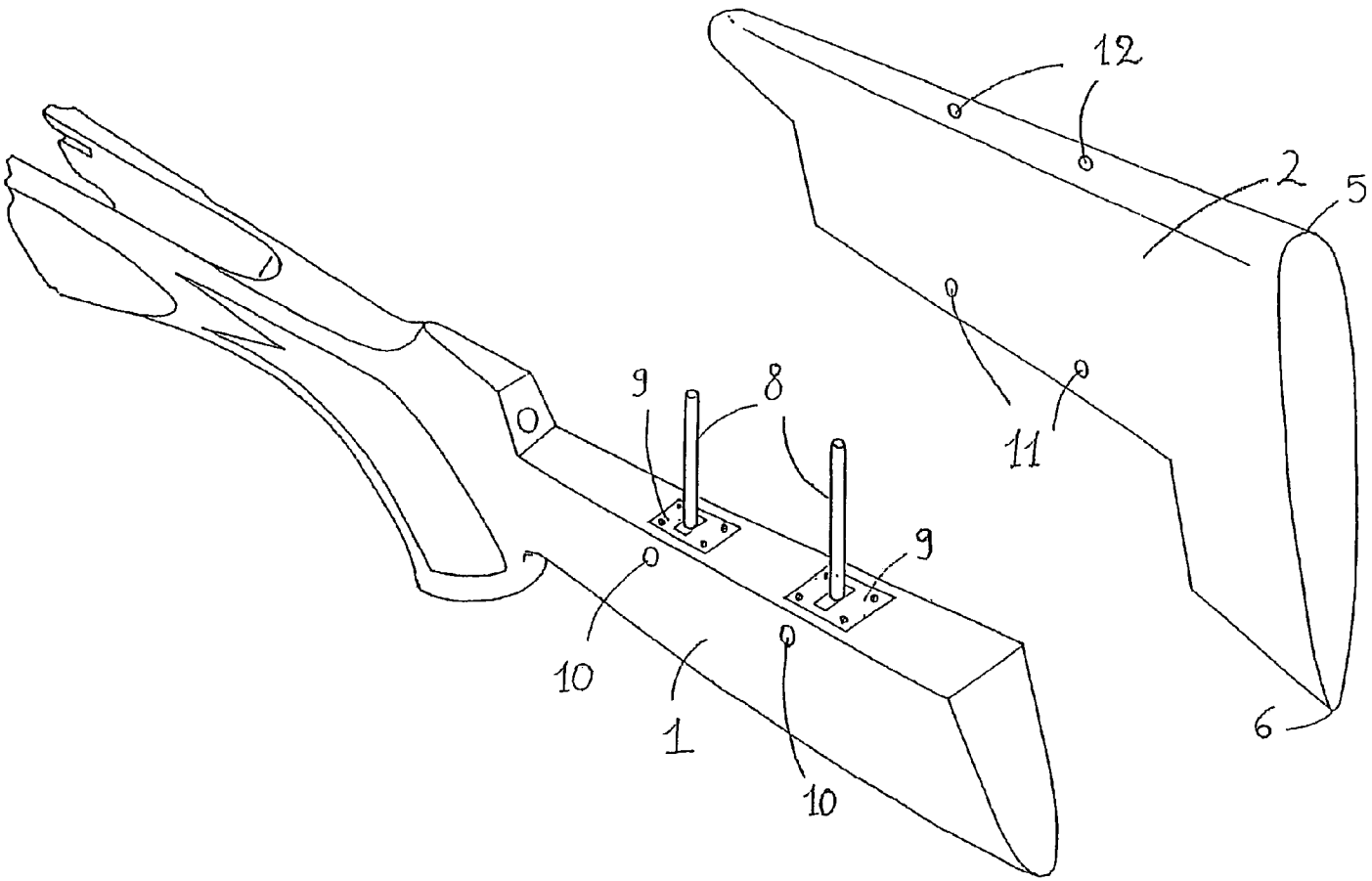
FIG. 2 shows the elements which form the stock and the system of connection of the elements.

Moving on to FIG. 2, the elements 1 and 2 are joined to each other by means of pins 8 attached by one end to plates 9 embedded in either of elements 1 or 2 of the stock, and attached by the other end by means of screws 11 to the plates embedded in either element 2 or 1 as described above. Said plates can regulate mircrometrically the position of the ends of the pins 8 in a transverse direction to the stock, as said ends are attached to a respective one of worm screws 10.

In a preferred embodiment, regulation of the horizontal movement of element 1 in relation to element 2 therefore takes place with micrometric regulation of the position of the pins 8 by actuating the worm screws 10 which move the point of attachment of the pin in a transverse direction, enabling translation (moving both pins 8 in the same direction) or rotation (modifying the position of the pins 8 in opposite directions or adjusting only one thereof) of one element in relation to the other.

Vertical adjustment instead takes place both by-actuating the screws 12 which regulate the height of the pins and therefore the vertical position of the elements, and by inserting shims between the two elements.

Figure 3:
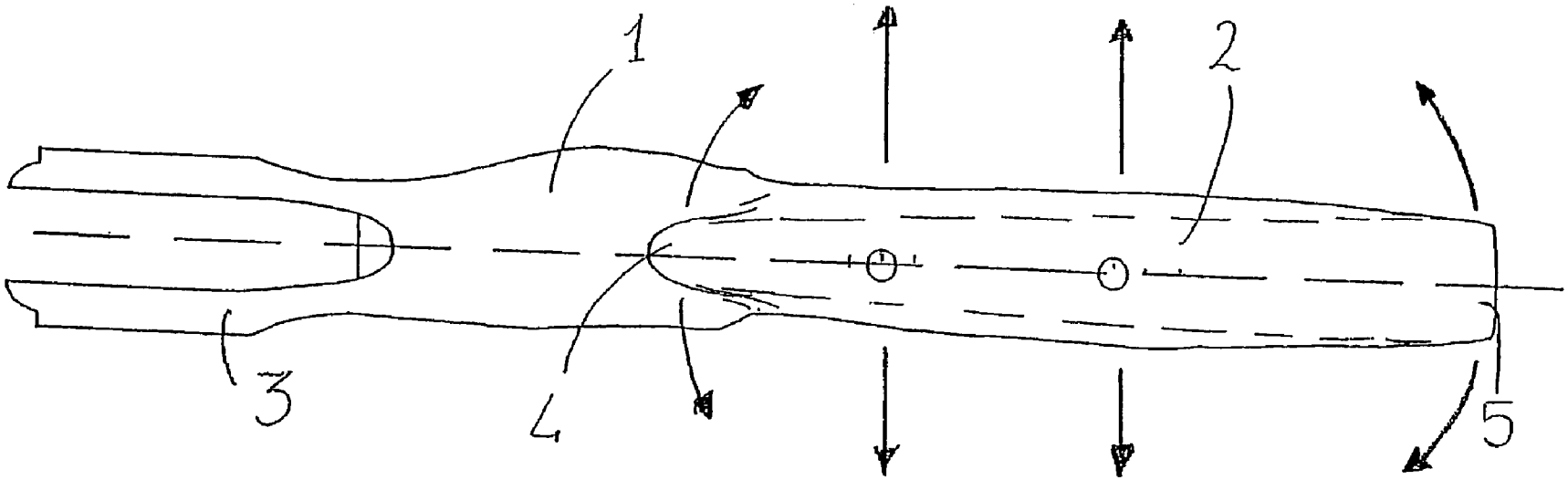
FIG. 3 is a view from above of how the stock is presented perfectly in line with the barrels.

Referring to FIG. 3, some examples of possible positions which element 2 can adopt in relation to element 1 are illustrated: as can easily be seen, both translations of the whole part and partial relative rotations both in relation to the front pin, with the nose 4 still and the heel 5 moved, and in relation to the rear pin, where vice versa the heel 5 remains still and the nose 4 moves, are possible.

Figure 4:
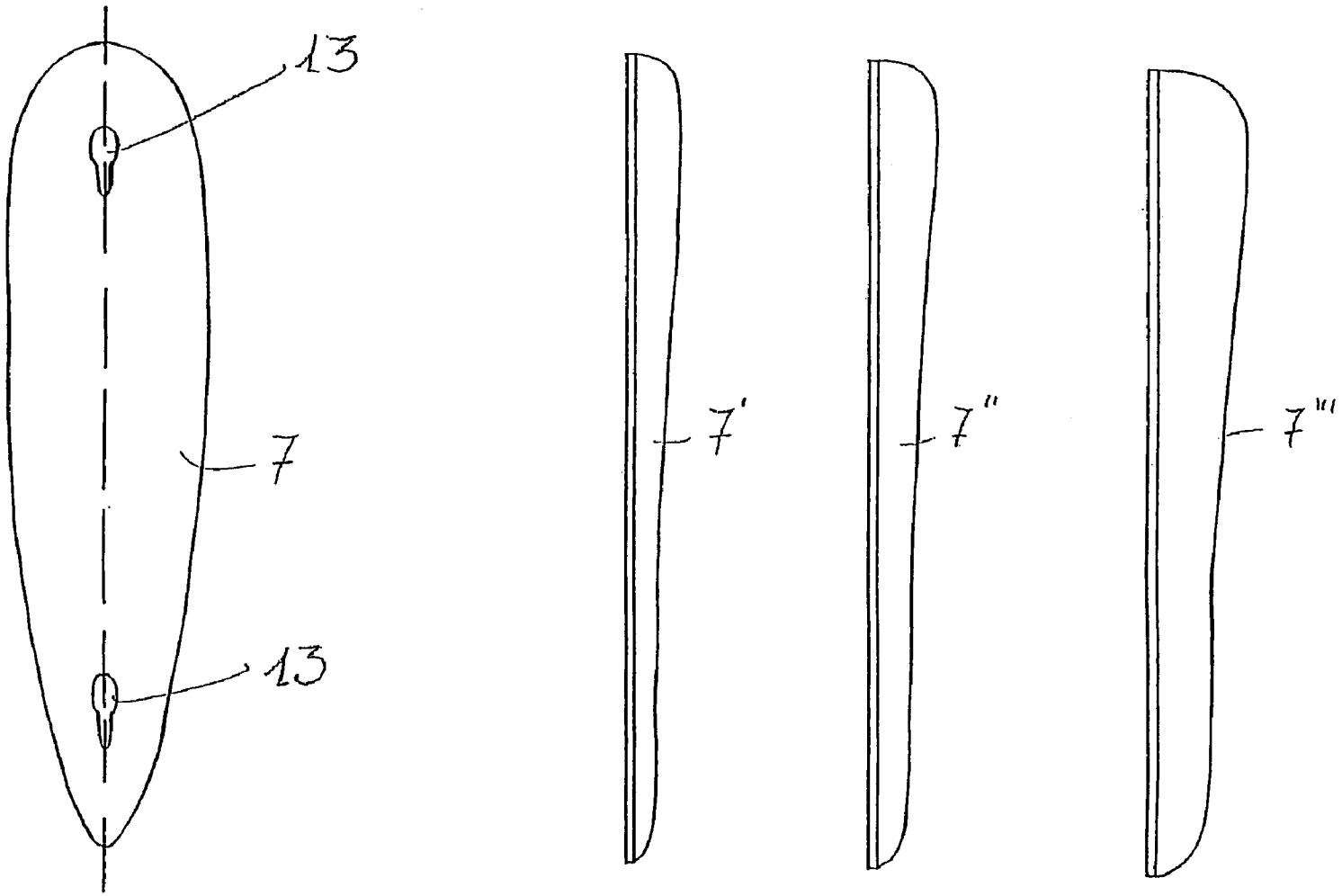
FIG. 4 shows the various types of butt plate which can be attached to the end of the stock to adapt the rifle in a longitudinal direction.

For longitudinal adjustment of the stock, different butt plate sizes are used, as illustrated in FIG. 4: the system of attachment of the buff is by bayonet coupling of the attachment holes 13 on special pins formed in the end part of the stock.

Adjustment takes place with replacement of the butt plate with others 7', 7'', 7''' of different thickness which allow optimal adaptation in a longitudinal direction of the rifle to the shooter.

As can be seen from the drawings and from the description, not only does the appearance of the stock vary but also the general alignment of the rifle with the body of the shooter: a longitudinal variation with the butt plate and a vertical and horizontal variation are obtained by adjusting the connection pins which adapt the rifle itself to the shooter.

The fact that the stock is no longer a rigid element but is instead composed of two parts introduces elasticity into the same which damps the recoil caused by the shot: although the pins are sufficiently rigid to allow the precision of the aim on the target to be maintained, they will never be infinitely rigid and this allows a damping element to be obtained.

It is understood that all that is described above is purely a non-limiting description of the different possible embodiments of the invention.

The invention claimed is:

1. A stock for a rifle, comprising:

a first element that is integral with a breechblock of the rifle and not in direct contact with a shoulder of a user during operation of the rifle;

a second element that is not integral with the breechblock and rests on the shoulder of the user during operation of the rifle, said second element being rotatable on a horizontal plane relative to said first element; and two rigid pins that join said first and second elements to each other, said two rigid pins each being attached by one end to a respective one of two first plates that are embedded in one of said first and second elements, said two first plates each having a respective worm screw therein to which a respective said one end is attached so that said one ends of said two pins are transversely movable by operation of said worm screws, said two pins each being attached by an opposite end by means of further screws to a respective one of two second plates that are embedded in the other one of said first and second elements.

2. The stock of claim 1, further comprising a second set of screws in said other of said first and second elements, said second set of screws extending into a side to respective ones of said opposite ends of said two pins to adjust a height of said two pins.

3. The stock of claim 2, wherein moving said two pins in a same transverse direction causes reciprocal translation on the horizontal plane.

4. The stock of claim 2, wherein moving said two pins in opposite directions, or moving only one of said pins, causes reciprocal rotation on the horizontal plane.

5. The stock of claim 1, further comprising shims for vertically adjusting said first element relative to said second element.

6. The stock of claim 1, wherein said two first plates are in said first element.

7. A stock for a rifle, comprising:

a first element that is arranged and adapted to immovably attach to a breechblock of the rifle;

second element rotatable about a longitudinal axis of the rifle and relative to said first element, said second element having a vertically oriented butt plate that is arranged to rest on a user during use of the rifle; and two spaced-apart and vertically oriented pins that join said first and second elements to each other, said two pins each being attached at one pin end to a respective one of two first plates in said first element and attached at an opposite pin end to a respective one of two second plates in said second element, said first plates each comprising a respective horizontally oriented worm screw that moves a respective said pin end transverse to the longitudinal axis of the rifle to cause said second element to rotate relative to said first element.

* * * * *